United States Patent [19]

Shibata

[11] Patent Number: 4,918,307

[45] Date of Patent: Apr. 17, 1990

[54] SAMPLE HOLDER FOR GLOW DISCHARGE MASS SPECTROMETER

[75] Inventor: Masahiro Shibata, Osaka, Japan

[73] Assignee: Sumitomo Electric Industries, Ltd., Osaka, Japan

[21] Appl. No.: 213,199

[22] Filed: Jun. 29, 1988

[30] Foreign Application Priority Data

Jun. 29, 1987 [JP] Japan ..... 62-101326[U]

[51] Int. Cl.[4] ..... H01J 49/04

[52] U.S. Cl. ..... 250/288; 204/192.13

[58] Field of Search ..... 250/288; 204/192.13

[56] References Cited

U.S. PATENT DOCUMENTS 4,698,256 10/1987 Giglia et al. ..... 428/216

OTHER PUBLICATIONS

Coburn et al., Journal of Applied Physics, vol. 45, No. 4, Apr. 1974, pp. 1779–1786.

Glow Discharge Mass Spectrometry—Prog. Analyst. Spectrosc., vol. 11, pp. 53–110—Harrison et al—1988.

VG Isotopes—Technical Improvements Excepted—Mar. 1986.

*Primary Examiner*—Jack I. Berman

*Attorney, Agent, or Firm*—Cushman, Darby & Cushman

[57] ABSTRACT

A sample holder for a glow discharge mass spectrometer which is made of quartz or a sample holder comprising a sample holder body and a coating film of an insulating material covering the surface of the sample holder body for precisely analyzing the content of a trace element in a material.

3 Claims, 4 Drawing Sheets

Fig. 1
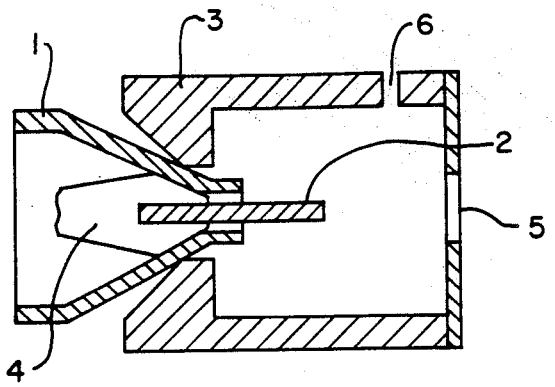
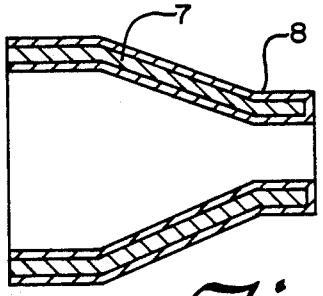
Fig. 2

SAMPLE HOLDER FOR GLOW DISCHARGE MASS SPECTROMETER

BACKGROUND OF THE INVENTION

1. Field of the Invention

The present invention relates to a sample holder for a glow discharge mass spectrometer. More particularly, it relates to a sample holder which holds a sample to be analyzed by glow discharge mass spectroscopy for analyzing trace element(s) contained in a highly pure sample such as a metal, semiconductor or ceramic sample, and, further, the sample holder electrically insulates the sample from an anode.

2. Description of the Related Art

In a glow discharge mass spectrometer, an insulating sample holder, which is preferably in the form of a cone, is made of an insulating material for electrically insulating a sample which acts as a cathode from an anode. As the insulating material, polytetrafluoroethylene (hereinafter referred to as "PTFE") is preferably used, since it is easy to process and has good insulating properties and chemical resistance to a chemical used for cleaning a surface of the holder such as an acid.

FIG. 1 shows a cross sectional view of a typical glow discharge source, which comprises an insulating sample holder 1, a sample 2, an anode 3, a metal chuck 4, an ion exit slit 5 and a gas inlet 6. Glow discharge is generated in a gap between the sample, which is held by the metal chuck, 4 and the anode 3, where the sample acts as the cathode. The insulating sample holder electrically insulates the anode from the metal chuck 4 and the sample 2. Ions generated by glow discharge exhaust from the ion exit slit 5 into a mass spectrometer (not shown).

As described above, the sample holder 1 is conventionally made of PTFE.

When the glow discharge source is used, the atmosphere is evacuated to a pressure of about 1 to $5\times10^{-8}$ Torr before discharge. Thereafter, a very small amount of argon gas is supplied from the gas inlet 6 into the glow discharge source, and then the discharge is started. In FIG. 1, when the sample holder is made of PTFE, air or some other gas is trapped in the pores of the PTFE material, even after the glow discharge source is evacuated for a long time, since the PTFE material is very porous. Therefore, for a long time after the start of glow discharge, ion species of residual gases such as $N^+$, $O^+$ and $CO^+$ are detected with high intensity. Since these ions may cause interferences in analysis, it is necessary to wait untill the intensities of the residual gases decrease before analysis of trace elements such as S, Si and Fe. This waiting time decreases the efficiency of the analysis. Since PTFE contains fluorine atoms, fluorine-containing ion species such as $^{19}F^+$ and $^{31}CF^+$ are generated and cause interferences in analysis like the above described ion species.

In addition, after repeated measurements, the tip end of the sample holder is severely damaged and becomes largely uneven. Therefore, deposited materials on the tip end are not removed by washing with an acid and remain on the surface of the sample holder. Further, whisker-like materials are formed on the surface of the sample holder which cause abnormal discharge during measurement.

SUMMARY OF THE INVENTION

An object of the present invention is to provide a sample holder for a glow discharge mass spectrometer which overcomes the above described problems of conventional sample holders and enables efficient and accurate analysis.

This and other objects of the present invention are accomplished by a sample holder for a glow discharge mass spectrometer which is made of quartz or comprises a sample holder body and a coating film of an insulating material covering the surface of the sample holder body.

BRIEF DESCRIPTION OF THE DRAWINGS

FIG. 1 is a cross sectional view of a glow discharge source,

FIG. 2 is a cross sectional view of one embodiment of a sample holder of the present invention.

DETAILED DESCRIPTION OF THE INVENTION

Figure 3:
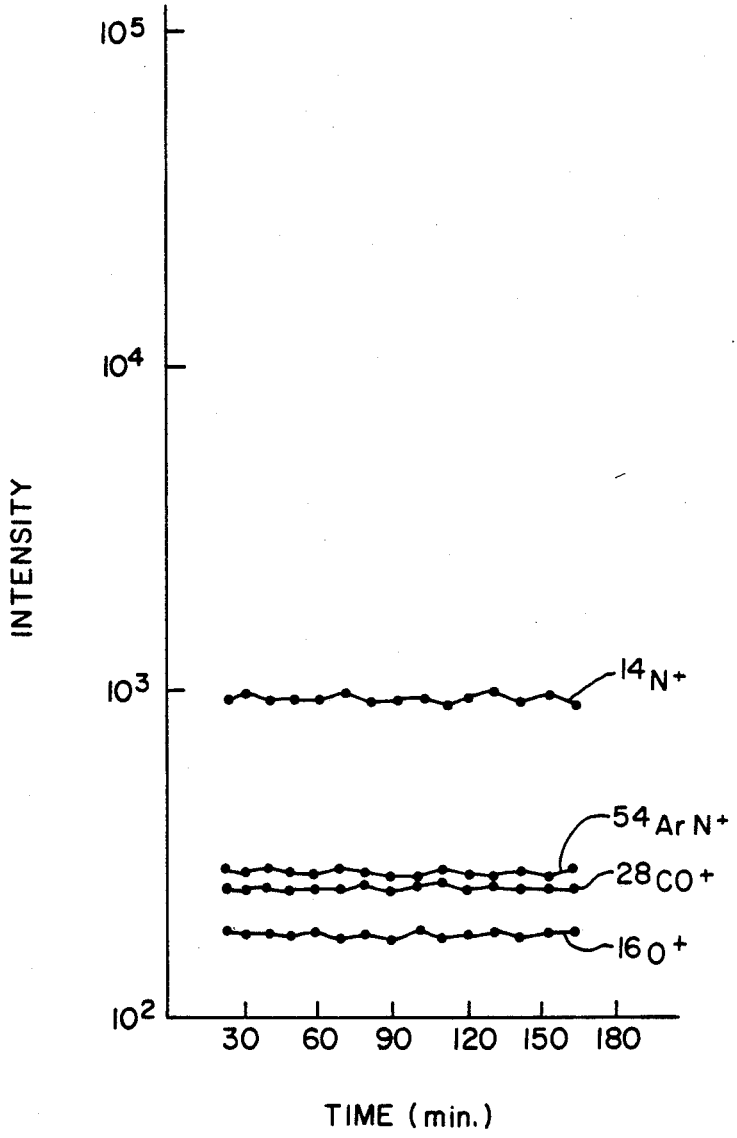
FIGS. 3 and 4 are graphs showing intensity changes of interference ions with time when the sample holder of the present invention having an insulating film of i-carbon and the conventional PTFE sample holder are used, respectively.

In the first embodiment of the present invention, the sample holder 1 is made of quartz. Since the quartz glass is non-porous, the defects of the PTFE made sample holder can be overcome.

However, when the sample holder made of quartz glass is used for trace analysis of silicon (Si) by glow discharge mass spectroscopy, quartz glass is also sputtered so that contamination due to Si, which is one of the constituent elements of quartz glass, occurs. In elemental analysis of trace impurity elements contained in a highly pure material, particularly in purity analysis of a compound semiconductor such as GaAs and InP or a raw material for such semiconductor, Si is often one of important elements to be analyzed, and its analytical accuracy should be in the order of ppm or less. Therefore, a sample holder which causes no or substantially no contamination due to Si is also desired.

Accordingly, in the second embodiment of the present invention, very dense i-carbon, crystalline diamond or crystalline boron nitride is preferably used as the insulating material for coating a sample holder. For forming the i-carbon or crystalline diamond thin film, plasma CVD (chemical vapor deposition), particularly low temperature plasma CVD, is preferably used. For forming the boron nitride thin film, PVD (physical vapor deposition) or CVD is particularly preferred.

The thickness of the insulating film depends on other analysis conditions and the like. Generally, the thickness is from 0.1 to 1 $\mu$m.

When a base material of the sample holder is PTFE, PTFE is heated to a temperature not higher than 100° C. during the formation of the insulating film by the above preferred methods, and thus any problem such as deformation of the PTFE sample holder is not caused.

By using the sample holder of the present invention which is coated by the i-carbon film, evacuation time for degassing the glow discharge source can be greatly shortened. During discharge, not only the sample but also the sample holder are sputtered. While from the conventional PTFE made sample holder, ion species consisting of carbon and/or fluorine atoms are generated, from the i-carbon insulated sample holder, ion species consisting of only carbon atoms are generated since only the i-carbon film is sputtered. Therefore, the number of interfering ion species is decreased and, in turn, the efficiency of analysis is increased.

In another preferred embodiment of the present invention, a sample holder made of quartz glass is coated with the insulating film. When such an insulated sample holder is used, contamination due to Si does not occur since the quartz glass is not sputtered. This type of the sample holder is particularly useful for the analysis of Si in the sample.

FIG. 2 schematically shows a cross sectional view of the typical sample holder of the present invention, which comprises a sample holder body 7 made of PTFE or quartz glass and an insulating film 8 made of i-carbon, crystalline diamond or boron nitride.

PREFERRED EMBODIMENTS OF THE INVENTION

The present invention will be illustrated in further detail by the following Examples.

EXAMPLE 1

A sample holder made of quartz glass material 7 coated with an insulating film 8 of i-carbon having a thickness of 0.5 μm as shown in FIG. 2 was produced and used for glow discharge mass spectroscopy of highly pure GaAs crystal by means of the VG 9000 glow discharge mass spectrometer (manufactured by VG isotopes Ltd., England) under the following glow discharge conditions:

Discharge voltage: 1 kV
Discharge current: 2 mA
Discharge gas: 6N argon

Changes of intensities of interfering ion species generated from the residual gases were measured with time after the initiation of glow discharge. The results are shown in FIG. 3.

COMPARATIVE EXAMPLE 1

For comparison, glow discharge mass spectroscopy of the same sample as used in Example 1 was carried out under the same conditions as in Example 1 using a sample holder made of PTFE having no insulating film.

Figure 4:
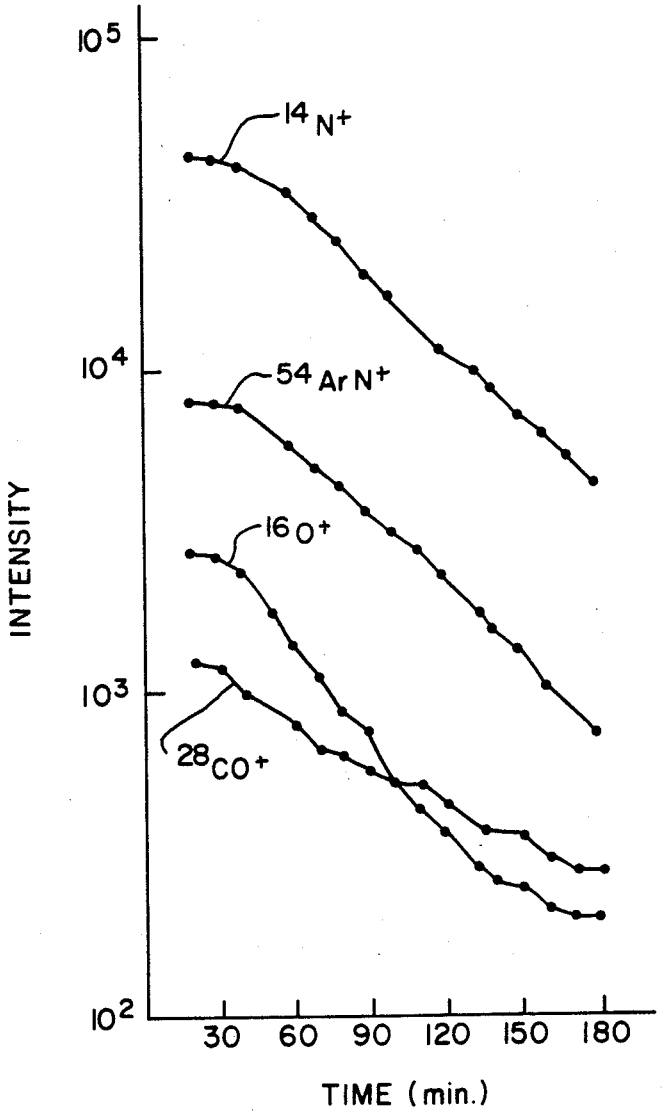

The results are shown in FIG. 4.

In FIGS. 3 and 4, to designate the ion species, the numerals indicate mass numbers of the ion species.

From FIG. 3, it is understood that, in Example 1, the intensities of all the ion species, namely $^{14}N^+$, $^{54}ArN^+$, $^{28}CO^+$ and $^{16}O^+$, were stabilized within about 20 minutes from the start of the glow discharge. On the contrary, in Comparative Example 1, it is apparent from FIG. 4 that more than 3 hours from the start of glow discharge was required for stabilizing the intensities of the ion species. This means that, by using the sample holder of the present invention, the time required before the start of analysis is shortened to about one ninth of that in Comparative Example 1.

EXAMPLES 2 AND 3

To evaluate the contamination due to silicon from the sample holder, the mass spectroscopic analysis of highly pure GaAs was carried out in the same manner as in Example 1 but using, in one analysis, a quartz made sample holder having an i-carbon coating film of a thickness equal to 0.5 μm (Example 2) and, in another analysis, a quartz glass made sample holder (Example 3). Detected amounts of silicon in each run are shown in the following Table.

TABLE

| Run No. | Example 2 | Example 3 |
|---|---|---|
| 1 | <0.001 ppma | 5.8 ppma |
| 2 | <0.001 ppma | 4.9 ppma |
| 3 | <0.001 ppma | 4.6 ppma |

As is apparent from the results of the Table, the contamination due to silicon in Example 2 is less than one thousandth of that in Example 3.

The lower limits of detection of various elements in this Example were as follows:

| Element | Lower limit of detection (ppba) |
|---|---|
| B | <0.3 |
| Na | <0.4 |
| Mg | <0.5 |
| Al | <0.4 |
| Si | <0.8 |
| P | <0.5 |
| S | <0.2 |
| Ti | <0.6 |
| V | <0.4 |
| Cr | <0.5 |
| Mn | <0.2 |
| Fe | <0.3 |
| Co | <0.4 |
| Ni | <0.6 |
| Cu | <0.2 |
| Zn | <0.3 |
| Cd | <0.6 |
| Sb | <0.7 |
| I | <0.4 |

EXAMPLE 3

Figure 5:
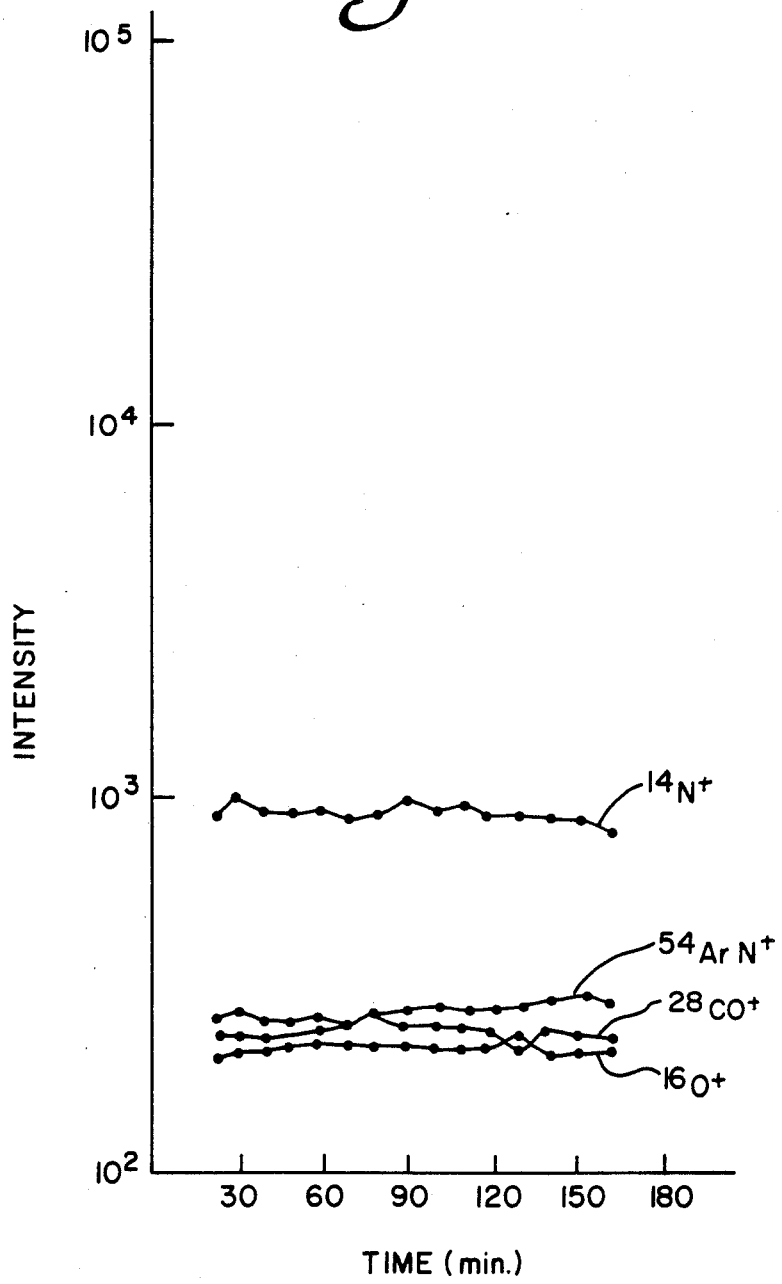
FIG. 5 is a graph showing intensity changes of interference ions with time when the sample holder made of quartz according to the present invention is used.

In the same manner as in Example 1, but using a sample holder made of quartz glass, the glow discharge mass spectroscopic analysis of highly pure GaAs crystal was performed. The results are shown in FIG. 5.

What is claimed is:

1. A sample holder for a glow discharge mass spectrometer which comprises a sample holder body and a coating film of an insulating material of either i-carbon or crystalline diamond covering the surface of the sample holder body.

2. The sample holder according to claim 1, wherein the sample holder body is made of polytetrafluoroethylene.

3. The sample holder according to claim 1, wherein the sample holder body is made of quartz glass.

* * * * *